US010151550B2

(12) United States Patent
Borders

(10) Patent No.: US 10,151,550 B2
(45) Date of Patent: Dec. 11, 2018

(54) FIREARM SINGLE-SHOT BOLT CATCH ASSEMBLY AND METHOD OF OPERATION

(71) Applicant: Brian T. Borders, East Amherst, NY (US)

(72) Inventor: Brian T. Borders, East Amherst, NY (US)

( * ) Notice: Subject to any disclaimer, the term of this patent is extended or adjusted under 35 U.S.C. 154(b) by 0 days.

(21) Appl. No.: 15/726,573

(22) Filed: Oct. 6, 2017

(65) Prior Publication Data

US 2018/0100714 A1 Apr. 12, 2018

Related U.S. Application Data

(60) Provisional application No. 62/404,799, filed on Oct. 6, 2016.

(51) Int. Cl.
*F41A 17/42* (2006.01)
*F41A 3/72* (2006.01)
*F41A 19/46* (2006.01)

(52) U.S. Cl.
CPC ..... *F41A 17/42* (2013.01); *F41A 3/72* (2013.01); *F41A 19/46* (2013.01)

(58) Field of Classification Search
CPC ..... F41A 17/42; F41A 3/72; F41A 3/68
See application file for complete search history.

(56) References Cited

U.S. PATENT DOCUMENTS

| | | | | |
|---|---|---|---|---|
| 4,057,003 | A | 11/1977 | Atchisson | |
| 6,510,778 | B1 | 1/2003 | Irwin | |
| 6,851,346 | B1 | 2/2005 | Herring | |
| 7,261,029 | B1 | 8/2007 | Davis | |
| 7,661,219 | B1 | 2/2010 | Knight, Jr. et al. | |
| 8,387,296 | B2 | 3/2013 | Overstreet et al. | |
| 8,695,477 | B2 | 4/2014 | Esch | |
| 9,810,493 | B2 * | 11/2017 | Fluhr | F41A 17/36 |
| 2017/0284761 | A1 * | 10/2017 | Lewis | F41A 3/66 |

FOREIGN PATENT DOCUMENTS

WO WO 2018/067912 * 4/2018

* cited by examiner

*Primary Examiner* — Stephen Johnson
(74) *Attorney, Agent, or Firm* — Vincent G. LoTempio; Kloss, Stenger & LoTempio; David T. Stephenson

(57) ABSTRACT

A firearm single-shot bolt catch assembly and method of operation. The automatic firearm single-shot bolt catch assembly uses a tensioned spring that operates with a bolt catch. The tension from the spring works to pivotally articulate a plate in the bolt catch to a catch position, which restricts the recoiling bolt carrier group in linear path of the firearm. The tension from the spring presses the plate upwardly into the linear path to restrict the passage of, and hold, the bolt carrier group towards the rearward end of the firearm. This restriction of movement inhibits automated recoiling responses from the bolt carrier group, consequently creating a single-shot mode by disabling automated firing sequence of the firearm. Applying force to a lever that forms in the bolt catch overcomes the spring bias to displace the plate out of the linear path followed by the bolt carrier.

19 Claims, 8 Drawing Sheets

FIREARM SINGLE-SHOT BOLT CATCH ASSEMBLY AND METHOD OF OPERATION

CROSS REFERENCE OF RELATED APPLICATIONS

This application claims the benefits of U.S. provisional application No. 62/404,799, filed Oct. 6, 2016 and entitled SINGLE SHOT BOLT CATCH ASSEMBLY, which provisional application is incorporated by reference herein in its entirety.

FIELD OF THE INVENTION

The present invention relates generally to a firearm single-shot bolt catch assembly and method of operation. More so, the automatic firearm single-shot bolt catch assembly utilizes a tensioned spring that operates with a bolt catch; whereby the tension from the spring works to pivotally articulate a plate in the bolt catch to a catch position, which restricts the recoiling bolt carrier group in linear path of the firearm; whereby the tension from the spring presses the plate upwardly into the linear path to restrict the passage of, and hold, the bolt carrier group towards the rearward end of the firearm; whereby the restriction of movement inhibits automated recoiling responses from the bolt carrier group, consequently creating a single-shot mode by disabling the automated firing sequence of the firearm; and whereby applying force to a lever in the bolt catch overcomes the spring bias to displace the plate out of the linear path followed by the bolt carrier group.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a firearm is a portable gun that discharges projectiles that are driven by the action of an explosive force caused by pressure during the discharge of ammunition. An automatic firearm includes a firearm that continues to load and fire cartridges from its magazine as long as the trigger is depressed and until the magazine is depleted of available ammunition.

It is known in the art that a bolt is the part of a repeating, breech-loading firearm that blocks the rear of the chamber while the propellant burns and moves to facilitate loading of cartridges from the magazine. Automatic and semi-automatic firearms are provided with a bolt catch which retains the bolt in the open position upon firing the last round in a magazine. The bolt is thereafter manually released after a fresh magazine is inserted, so that a round is chambered in readiness for firing.

Typically, locking the bolt carrier group in its rearward position allows the user to look into the ejection port of the firearm and inspect the chamber for a live round or to clear an operational malfunction. Once a loaded magazine is inserted into the receiver, or a malfunction is cleared, the user needs an efficient means for releasing the bolt carrier group from the locked-back position.

Other proposals have involved restricting automatic recoil of the bolt or bolt carrier group. The problem with these bolt catch devices is that they do not convert automatic rifles to single-shot mode by automating the restriction of forward recoil by the bolt. Even though the above cited bolt catch devices meets some of the needs of the market, an automatic firearm single-shot bolt catch assembly that utilizes a tensioned spring operational with a bolt catch, such that tension from the spring works to displace a plate in the bolt catch to a catch position, which restricts the recoiling bolt carrier group in linear path of the firearm, is still desired.

SUMMARY

Illustrative embodiments of the disclosure are generally directed to a firearm single-shot bolt catch assembly and method of operation. The automatic firearm single-shot bolt catch assembly uses a tensioned spring that operates with a bolt catch. The tension from the spring works to pivotally articulate a plate in the bolt catch to a catch position, which restricts the recoiling bolt carrier group in linear path of the firearm. The tension from the spring presses the plate upwardly into the linear path to restrict the passage of, and hold, the bolt carrier group towards the rearward end of the firearm. This restriction of movement inhibits automated recoiling responses from the bolt carrier group, consequently creating a single-shot mode by disabling the automated firing sequence of the firearm. Applying force to a lever that forms in the bolt catch overcomes the spring bias to displace, or pivotally articulate, the plate out of the linear path followed by the bolt carrier group.

In one non-limiting embodiment, firearm single-shot bolt catch assembly provides a bolt catch operational with a firearm. The bolt catch comprises a plate and a lever. The plate is defined by a plate first end, a plate second end, a top edge, and a bottom edge forming a spring cavity. The lever is defined by a lever first end, a lever second end, and a middle region forming an aperture. The middle region of the lever joins with the plate in a generally coplanar relationship.

The automatic firearm single-shot bolt catch assembly further comprises a spring that detachably fits inside the spring cavity at the bottom edge of the plate. The spring is tensioned to bias the plate into a linear path followed by a bolt carrier group of a firearm. This restrictive disposition of the plate restricts the bolt carrier group at a rearward end of the firearm. Furthermore, applying force to the lever pivotally articulates the plate out of the linear path followed by the bolt carrier group.

One objective of the present invention is to reconfigure an automatic rifle pattern from an automatic or semi-automatic mode, to a single-shot mode.

Another objective is to adapt an automatic or semi-automatic firearm to be legal.

Yet another objective is to enable facilitated installation of a bolt catch into the receiver slot on the side of the firearm.

Another objective is to enable facilitated release of the bolt carrier group from a linear path in the firearm through application of force on the lever with the thumb.

Yet another objective is to provide a spring cavity in the bottom edge of the plate and a tensioned spring that fits into the spring cavity.

Yet another objective is to provide an inexpensive to manufacture automatic firearm single-shot bolt catch assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
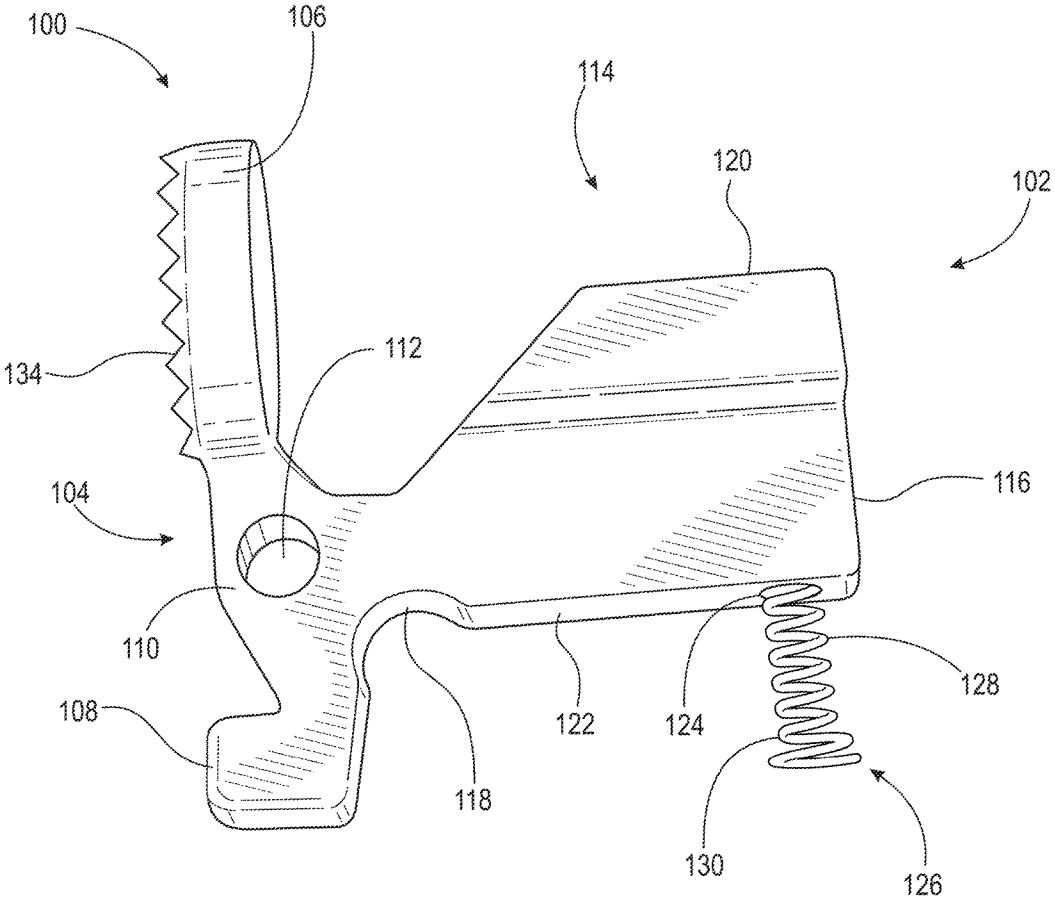
FIG. 1 illustrates a perspective side view of an exemplary firearm single-shot bolt catch assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one non-limiting embodiment of the present invention presented in FIGS. 1-8, a firearm single-shot bolt catch assembly 100 and method 800 of operation allows a firearm 200 to convert from an automatic mode to a single-shot mode by restricting movement of a bolt carrier group 202 that recoils forward from a rearward end 220 of a firearm 200 after discharging a projectile. Assembly 100 and method 800 works to automatically restrict bolt carrier group 202 to the rearward end 220 of firearm 200 with a spring tensioned plate 114; and then enables manual release of the bolt carrier group 202 to a release position 218 through application of force on a lever 104, so as to enable single-shot discharges. This single-shot mode allows a banned automatic firearm 300 to operate as a legal firearm 200.

As FIG. 1 references, firearm single-shot bolt catch assembly 100, hereafter "assembly 100" leverages the tensional forces inherent in a spring 126 with a bolt catch 102 operational in the firearm 200. The tension from spring 126 works to displace, or pivotally articulate, a plate 114 in the bolt catch 102 to a catch position 216, which restricts bolt carrier group 202 from recoiling forward along a linear path 214 that forms longitudinally along the rearward end 220 firearm 200. It is this restriction of automated recoil that converts firearm 200 into a single-shot mode.

Figure 2:
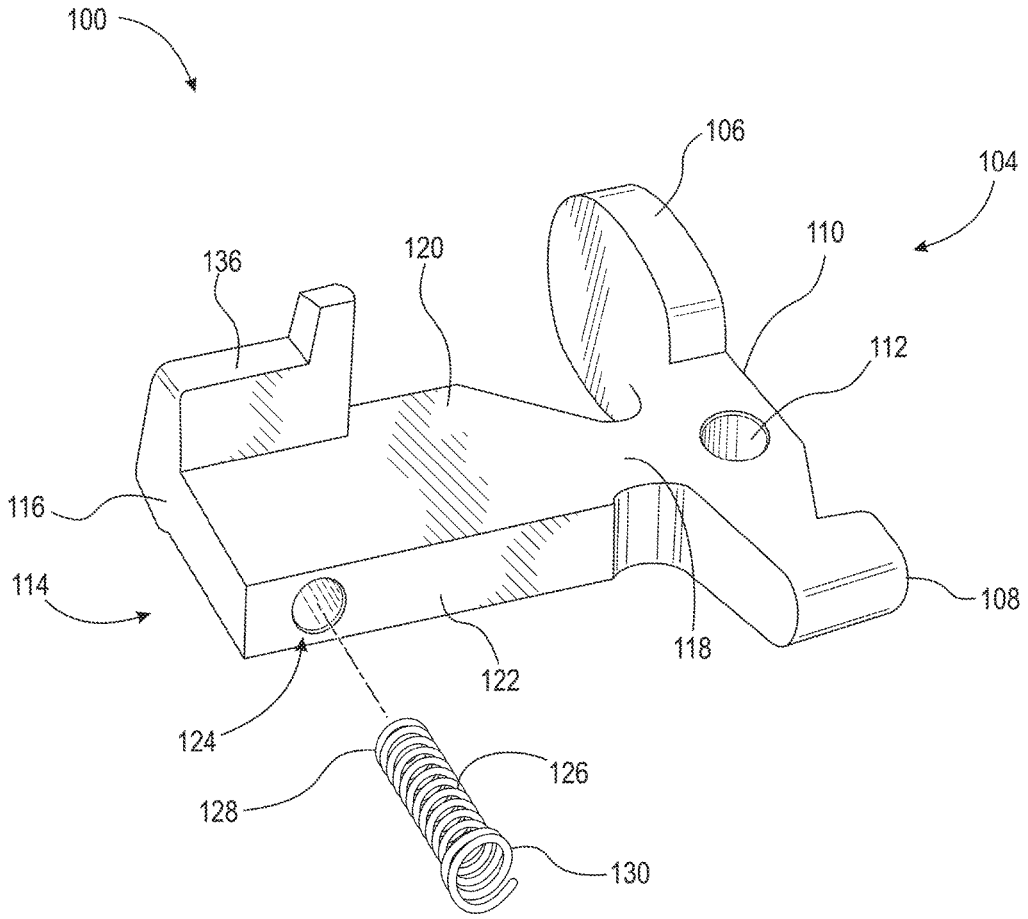
FIG. 2 illustrates a perspective bottom view of the firearm single-shot bolt catch assembly shown in FIG. 1, in accordance with an embodiment of the present invention.

Specifically, as shown in FIG. 2, the tension from spring 126 displaces, or pivotally articulates, the plate 114 upwardly into linear path 214 to restrict bolt carrier group 202 at the rearward end 220 of firearm 200. This restriction of movement inhibits automated recoiling responses from bolt carrier group 202, consequently creating a single-shot mode by disabling the automated firing sequence of the firearm 200. Furthermore, by applying force to a lever 104 in the bolt catch 102, the spring bias on plate 114 is overcome, enabling pivotal articulation of the plate 114, out of the linear path 214, and into a release position 218. Release position 218 enables forward recoil by bolt carrier group 202.

Figure 3:
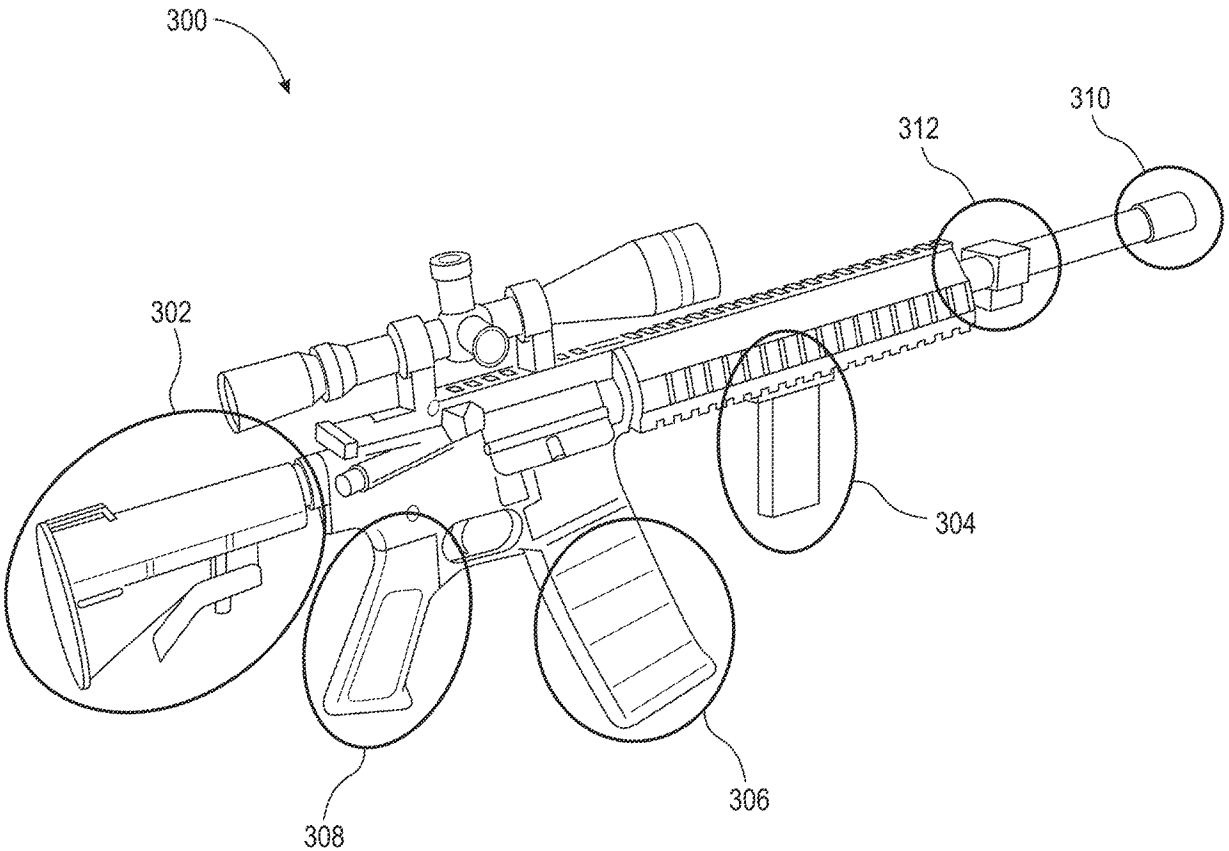
FIG. 3 illustrates a side view of an exemplary prior art automatic firearm with banned components, in accordance with an embodiment of the present invention.

As illustrated in FIG. 3, assembly 100 is especially useful for converting a banned automatic firearm 300 to a legal single-shot firearm 200. Those skilled in the art will recognize that multiple variations of automatic firearms have been developed to remove banned features. Examples of banned features include telescoping/foldable stocks, excessive grips, bayonets, and muzzled and threaded barrels. Examples of banned firearms are shown in FIG. 3, illustrating: an automatic firearm 300 having a folding stock 302; an automatic firearm 300 having a second handgrip 304; an automatic firearm 300 having a capacity to attach a magazine 306 outside the pistol grip, and a shroud (not shown) that is attached to or completely encircles the barrel and that permits the shooter to hold the firearm with the non-textured grip surface hand without being burned.

Furthermore, the automatic firearm 300 may have a telescoping stock (not shown); an automatic firearm having a protruding pistol grip 308; an automatic firearm 300 having a thumb spring cavity stock (not shown); an automatic firearm 300 having a threaded barrel 310 that can accept accessories, such as flash suppressors, muzzle brakes, and compensators; and an automatic firearm 300 having a bayonet mount 312. The present disclosure works to adapt the banned automatic firearm 300 described above, to a legal single-shot firearm 200 by restricting forward recoiling of the bolt carrier group, and consequently limiting the number of shots fired in rapid succession.

Figure 4:
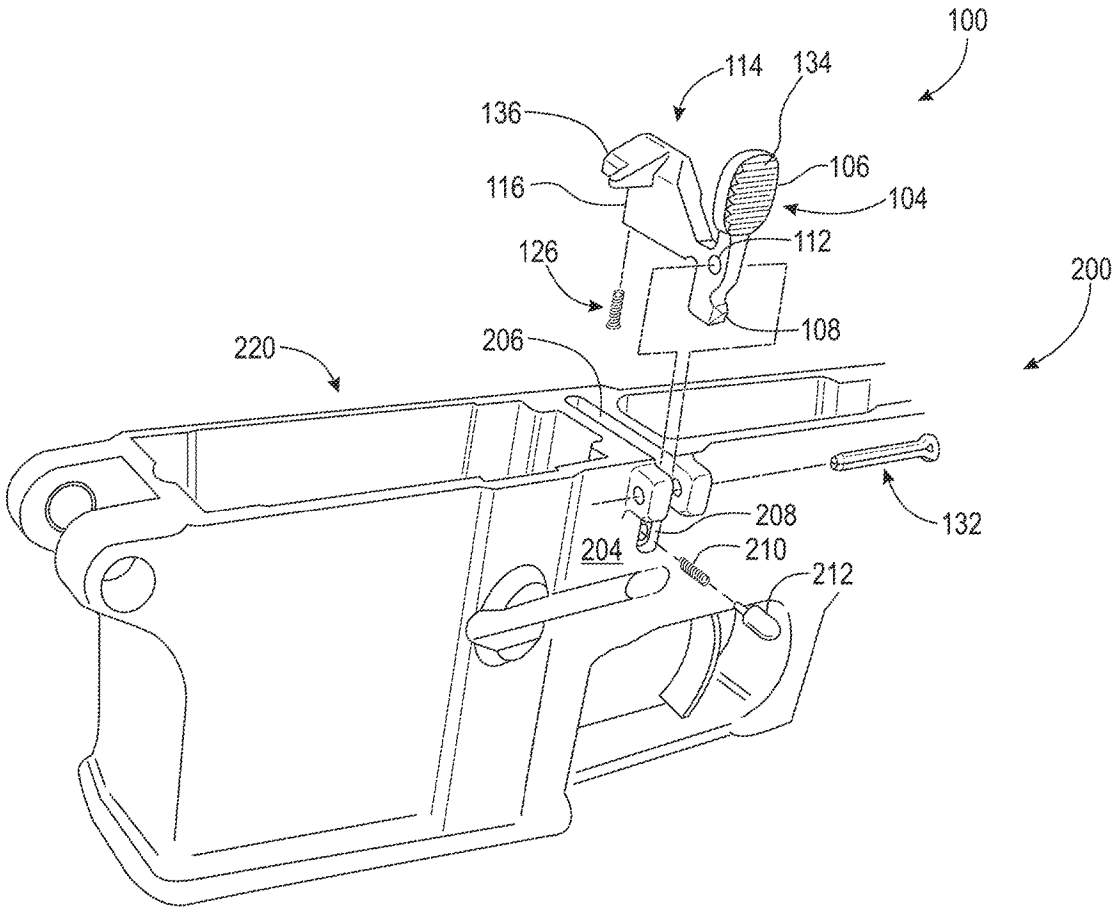
FIG. 4 illustrates a blow up view of the firearm single-shot bolt catch assembly disassembled for insertion with a firearm, in accordance with an embodiment of the present invention.

Looking now at the relationship between assembly 100 and firearm 200 in FIG. 4, the assembly 100 comprises a bolt catch 102 that is insertable through a receiver slot 206 in the side 204 of firearm 200. Bolt catch 102 is operational in a linear path 214 of firearm 200 followed by bolt carrier group 202. The essence of assembly is to pivotally displace bolt catch 102 in and out of path 214 followed by bolt carrier group 202 through use of a tensioned spring 126 that biases bolt catch 102 into the path 214, and a thumb-controlled lever 104 that displaces bolt catch 102 from the path 214.

In one non-limiting embodiment, bolt catch 102 comprises substantially two components fixedly joined together—a plate 114 and a lever 104. Lever 104 is generally elongated and flat, forming a surface for the thumb or other digits of the hand to manipulate bolt catch 102. Thus, lever 104 functions primarily to enable manipulation of bolt catch 102.

Looking again at FIG. 1, lever 104 may be defined by a first end 106 having a textured grip surface 134, a middle region 110 forming an aperture 112, and a second end 108. In one embodiment, known in the art, a pin 132 may pass through aperture 112 to enable insertion and attachment of bolt catch 102 to a receiver slot 206 forming on the side 204 of the firearm 200. Pin 132 may include a cotter pin, a role pin, and a fastening mechanism known in the art.

Plate 114 forms integrally with the lever 104, forming a unitary component to effectively restrain and release the bolt carrier group 202 along linear path 214 of firearm 200. In one embodiment, the plate 114 is generally flat and coplanar with lever 104. Plate 114 functions primarily to restrict linear displacement of bolt carrier group 202 at the rearward end 220 of firearm.

In one non-limiting embodiment, plate 114 may be defined by a top edge 120 forming a lip 136, a bottom edge 122, a plate first end 116, and a plate second end 118. The lip 136 at top edge 120 of plate 114 engages receiver slot 206 in firearm 200 to hold bolt catch 102 in place. Plate second end 118 fixedly joins with middle region 110 of lever 104 in a generally coplanar relationship. In one embodiment, plate 114 and lever 104 may be welded together to withstand recoil forces caused from discharge of firearm 200.

As shown back in FIG. 2, bottom edge 122 of plate 114 forms a spring cavity 124. Spring cavity 124 may be approximately in the center area of bottom edge 122 of plate 114. Bottom edge 122 of plate 114 has sufficient width to enable spring cavity 124 to form therein. In one embodiment, spring cavity 124 is dimensioned about 0.3" deep× 0.101" diameter. Though spring cavity 124 may have other dimensions in other embodiments.

In one non-limiting embodiment, assembly 100 further utilizes a spring 126 having a spring first end 128 and a spring second end 130. In one embodiment, spring second end 130 tapers out and is wider than spring first end 128. Spring first end 128 is sized and dimensioned to at least partially fit into the spring cavity 124 at bottom edge 122 of plate 114. Spring second end 130 buttresses the trough at the bottom of the slot of the receiver. In one embodiment, spring 126 is about 0.5"×0.1".

Figure 5:
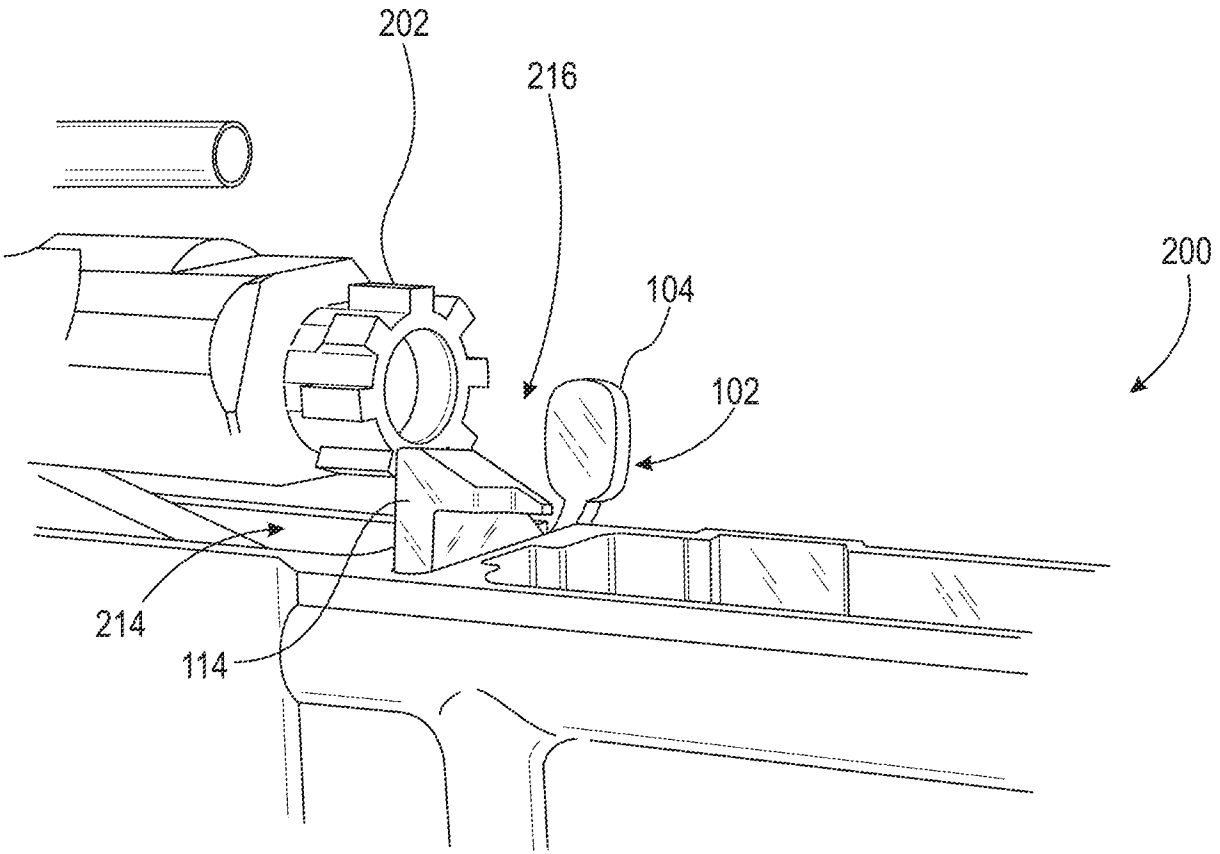
FIG. 5 illustrates a close up view of the firearm single-shot bolt catch assembly in the catch position, restricting forward recoil of a bolt carrier group, in accordance with an embodiment of the present invention.

In one non-limiting embodiment, spring 126 may have a tension. Those skilled in the art will recognize that an elastic object, such as a coil or spring, is used to store mechanical energy. When a coil or spring is compressed or stretched from its resting position, it exerts an opposing force approximately proportional to its change in length. The rate or spring constant of the coil or spring is the change in the force it exerts, divided by the change in deflection of the spring. Thus, the tension, or change in the force of spring 126 is sufficient to pivotally articulate, or press, bolt catch 102, and specifically the plate 114, upwardly, substantially into the linear path 214 of the bolt carrier group 202 in a catch position, as shown in FIG. 5. The tension from spring 126 also works to retain bolt carrier group 202 at the catch position until further operator action.

Thus, as the tensioned spring 126 pushes off the bottom of the trough in the receiver slot, the plate 114 of bolt catch 102 restricts passage of bolt carrier group 202. This inhibits the automatic responses from bolt carrier group 202, which creates a single-shot mode, and disables the automated firing sequence of firearm 200.

While forcibly retained in the catch position, bolt catch 102 restricts linear displacement of bolt carrier group 202 along path 214. Bolt carrier group 202 cannot move towards forward end of firearm 200 to enable access to another round without operator action, i.e., release of the bolt carrier group 202 from the receiver slot 206 in firearm 200. This is illustrated in FIG. 2, where assembly 100 does not release bolt carrier group 202 without fully releasing bolt catch 102 from receiver slot 206. This process creates, in essence, a single-shot firearm.

Figure 6:
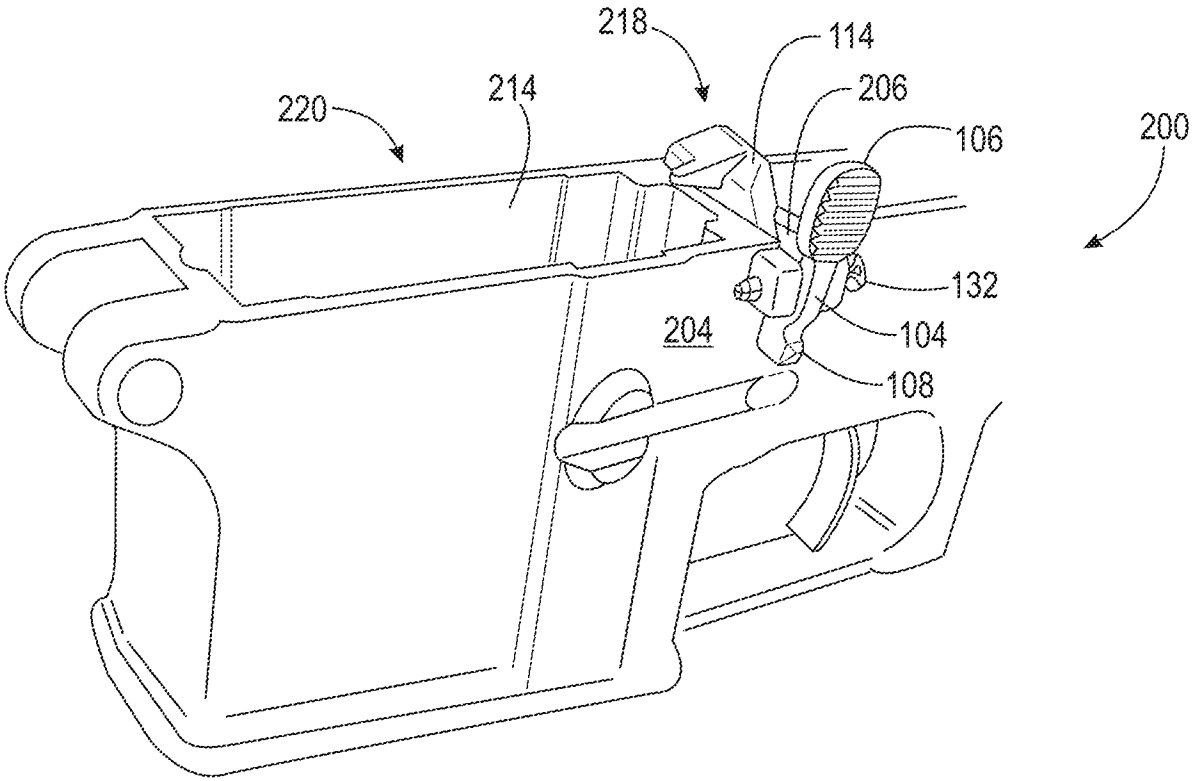
FIG. 6 illustrates a close up view of the firearm single-shot bolt catch assembly in the release position, enabling forward recoil of a bolt carrier group, in accordance with an embodiment of the present invention.

In order to fire a subsequent round, the bolt carrier group 202 must be released from the receiver slot 206. This is accomplished by applying force to the lever 104, so as to pivotally articulate the plate 114 out of the linear path 214. In some embodiments, the lever first end 106 may have a textured grip surface 134 to facilitate manipulation of lever 104 in such a manner. Only after plate 114 is displaced to release position 218 by manipulation of lever 104, may a subsequent projectile be discharged by firearm 200. Release position 218 is illustrated in FIG. 6.

In one non-limiting embodiment, plate first end 116 of plate 114 attaches in an articulated manner to a catch depression 208 that is disposed in the receiver slot of the firearm 200. The catch depression 208 is known in the art, forming an opening in the receiver slot 206. In another embodiment, a catch spring 210 and a catch plunger 212 are fitted into catch depression 208. Catch plunger 212 serves to fasten catch spring 210 into catch depression 208. In this manner, bolt catch 102 pivots about the catch plunger 212 between the release position 218 and the catch position 216.

Those skilled in the art will recognize that a bolt catch is a firearm component usually under the bolt carrier group that engages the bolt after the last round is fired. When the last round is fired, the bolt comes back to complete the cycle and eject the round. As the bolt reaches the rearward position of the firearm, it is caught by a pin or lever of the bolt catch. The bolt catch holds the bolt in a rearward position, thereby allowing the magazine to be replaced and the following round to be chambered without charging the action. In the present disclosure, bolt catch 102 includes a lever 104 release mechanism that allows bolt catch 102 to be pivotally articulated from a catch position 216 to a release position 218.

Thus, the purpose of a bolt catch on any firearm is to retain the principal members of the bolt or bolt carrier mechanism in a rearward position. The rear-hold position is desirable as a safety measure to allow an unobstructed view of the chamber of a firearm; to provide access to the chamber area for cleaning or clearing an obstruction, or other maintenance; as a signal to the operator that the magazine is empty; and to provide a means for rapid reloading, by holding the bolt carrier group 202 to the rearward end 220 of firearm 200 while the empty magazine is removed and a new magazine is installed.

For purposes of the present disclosure, the function of bolt catch 102 is to stop displacement of bolt carrier group 202 when pushed upward by the follower of an empty magazine (FIG. 5). Bolt catch 102 enables bolt carrier group 202 to be locked to the rearward end 220 of firearm 200 after expending a magazine so that a new one can be inserted and bolt catch 102 pushed back to the release position to fire another round. For this, after the last shot has been fired, the cartridge loader normally pushes the magazine onto the bolt catch lever and pivots it or pushes it into the movement path of the bolt, i.e. into the catch position.

The bolt carrier group 202, which first returns after firing then meets the bolt catch 102 when it again moves forward, and the two block each other in a reciprocal manner. After a full magazine has then been inserted, the bolt 202 can again be released through a manual actuation of the lever 104, i.e. the bolt catch 102 again ends up in the release position 218 (FIG. 6). The bolt carrier group 202 then guides a cartridge into the chamber as it moves forward, and the firearm 200 is again ready for discharging. It is this last step that the assembly 100 restricts bolt carrier group 202.

Figure 7:
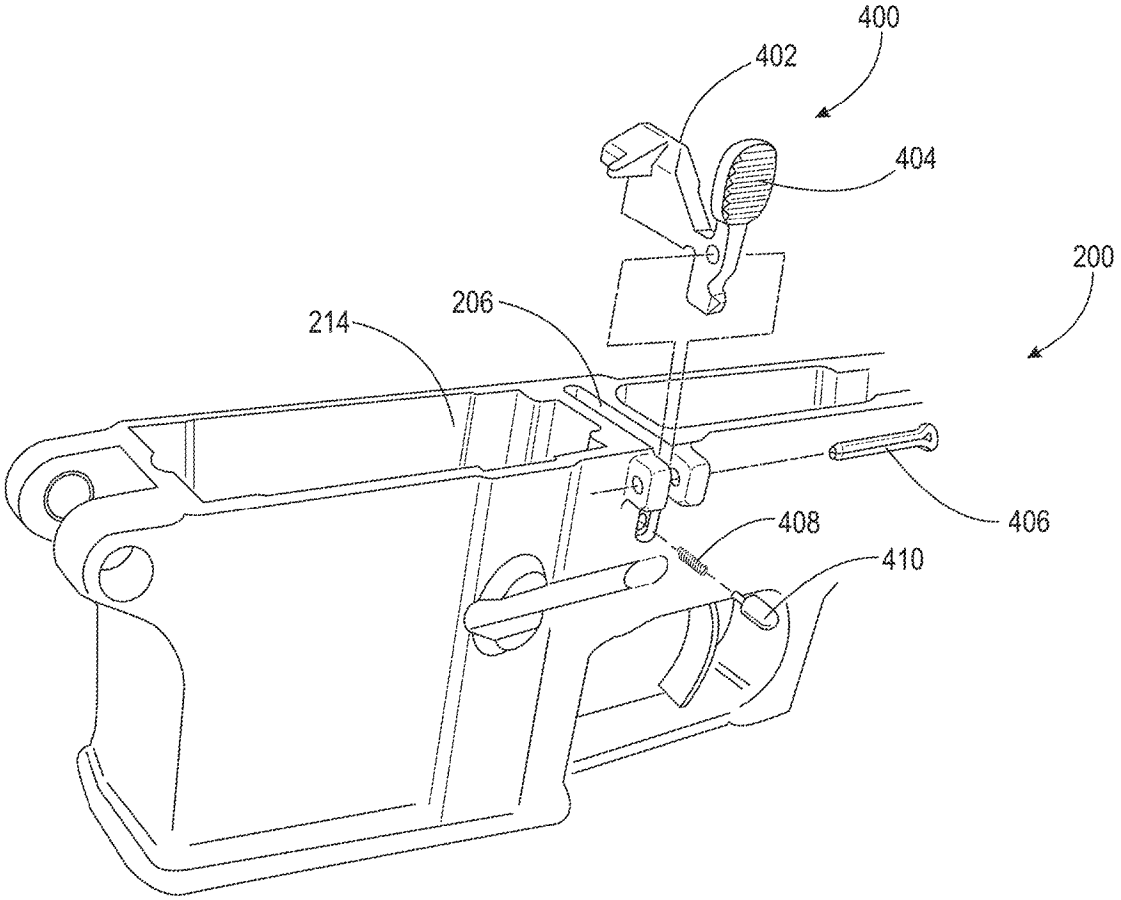
FIG. 7 illustrates a blow up view of a prior art bolt catch without the spring, disassembled for insertion with a firearm, in accordance with an embodiment of the present invention.

To highlight the advantages of assembly, FIG. 7 illustrates a prior art bolt catch 400 that operates substantially the same as the assembly 100 taught above, except that there is no use of the spring 126 that biases the plate 114 to the catch position 210. Nonetheless, the prior art bolt catch 400 still utilizes a plate 402 and an integrally formed lever 404 that are pivotally held into the receiver slot 206 with a pin 406, a catch spring 408, and a catch pin 410. The primary difference being that a spring 126, as taught above, does not insert into the bottom edge of the plate 402. Thus, the present disclosure configures the banned automatic firearm 300 described above, to a legal single-shot firearm 200 by restricting forward recoiling of the bolt carrier group with a plate 114 from the bolt catch 102, and consequently limiting the number of shots fired in rapid succession.

Figure 8:
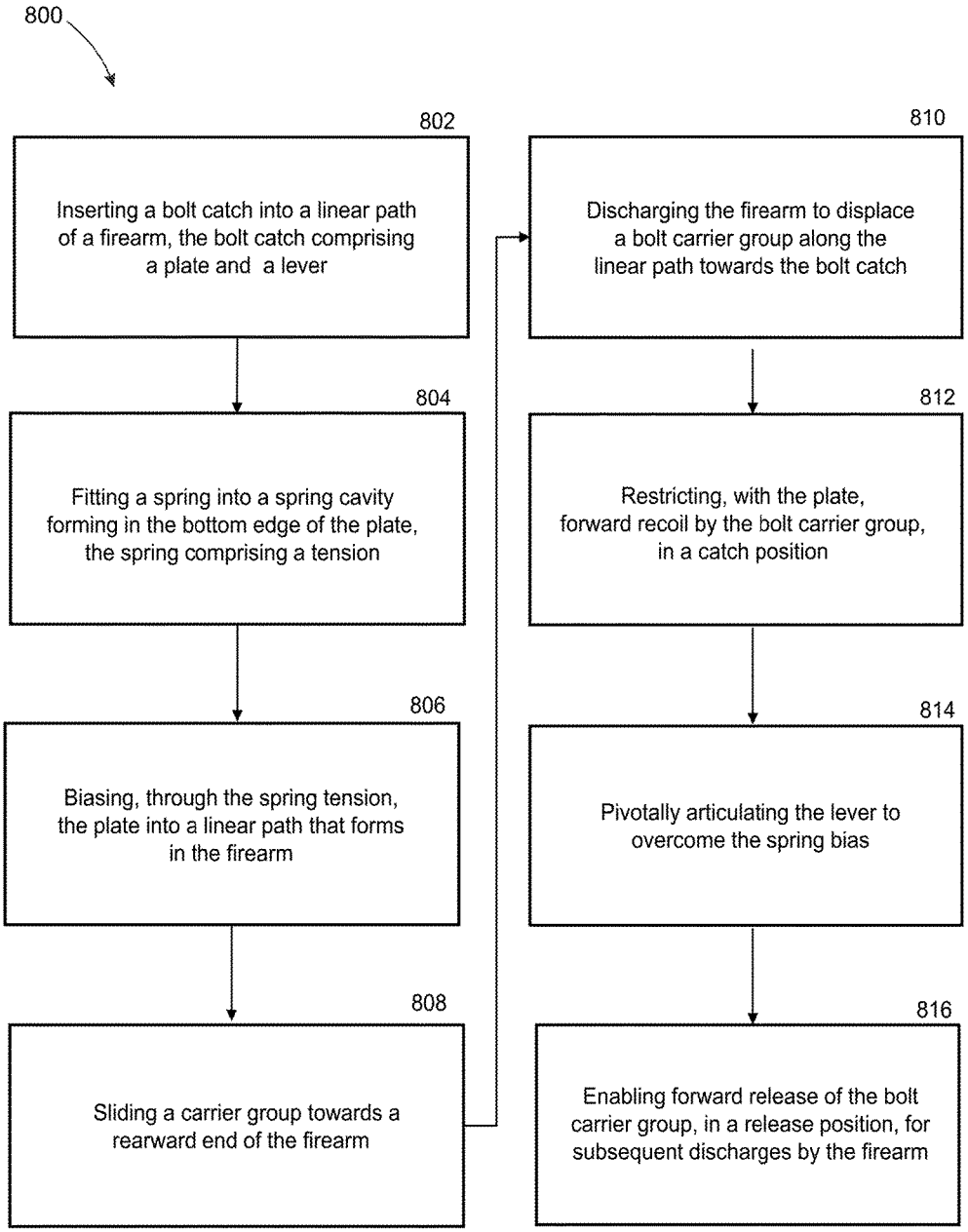
FIG. 8 illustrates a flowchart of an exemplary method for operation of a firearm single-shot bolt catch assembly in a firearm, in accordance with an embodiment of the present invention.

FIG. 8 illustrates a flowchart of an exemplary method 800 for operation of a firearm single-shot bolt catch assembly in a firearm. Method 800 may include an initial Step 802 of inserting a bolt catch into a linear path of a firearm, the bolt catch comprising a plate and a lever. The method 800 may further comprise a Step 804 of fitting a spring into a spring cavity forming in the bottom edge of the plate, the spring comprising a tension. A Step 806 includes biasing, through the spring tension, the plate into a linear path that forms in the firearm.

In some embodiments, a Step 808 comprises sliding a bolt carrier group towards a rearward end of the firearm. A Step 810 includes discharging the firearm to displace a bolt carrier group along the linear path towards the bolt catch. In some embodiments, a Step 812 may include restricting, with the plate, forward recoil by the bolt carrier group, in a catch position. A Step 814 comprises pivotally articulating the lever to overcome the spring bias. A final Step 816 includes enabling forward release of the bolt carrier group, in a release position, for subsequent discharges by the firearm.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A firearm single-shot bolt catch assembly, the assembly comprising:

a bolt catch comprising a plate and a lever, the plate defined by a plate first end, a plate second end, a top edge, and a bottom edge forming a spring cavity, the lever defined by a lever first end, a lever second end, and a middle region forming an aperture, the middle region of the lever being joined with the plate in a generally coplanar relationship; and a spring fitted inside the spring cavity at the bottom edge of the plate, whereby the spring is tensioned to bias the plate into a linear path followed by a bolt carrier group of a firearm, whereby applying force to the lever displaces the plate out of the linear path followed by the bolt carrier group.

2. The assembly of claim 1, wherein biasing the plate into the linear path forms a catch position.

3. The assembly of claim 2, wherein articulating the plate out of the linear path forms a release position.

4. The assembly of claim 3, wherein the catch position restricts passage of the bolt carrier group towards a rearward end of the firearm.

5. The assembly of claim 4, wherein the plate pivots between the catch position and the release position.

6. The assembly of claim 1, wherein the lever first end comprises a textured grip surface.

7. The assembly of claim 1, wherein the top edge of the plate comprises a lip.

8. The assembly of claim 1, wherein the dimension of the spring cavity comprises about 0.3 inches depth and a diameter of about 0.101 inches.

9. The assembly of claim 1, wherein the dimension of the spring is a length of about 0.5 inches and a diameter of about 0.1 inches.

10. The assembly of claim 1, wherein the middle region of the lever joins with the plate second end.

11. The assembly of claim 1, further comprising a pin, the pin passing through the aperture in the lever to enable detachable attachment of the bolt catch to a receiver slot in the firearm.

12. The assembly of claim 1, wherein a catch depression forms in a side of the firearm.

13. The assembly of claim 12, wherein a catch spring and a catch plunger are detachably fitted inside the catch depression.

14. The assembly of claim 1, wherein the firearm is a rifle.

15. A firearm single-shot bolt catch assembly, the assembly consisting of:

a bolt catch comprising a plate and a lever, the plate defined by a plate first end, a plate second end, a top edge comprising a lip, and a bottom edge forming a spring cavity, the lever defined by a lever first end comprising a textured grip surface, a lever second end, and a middle region forming an aperture, the middle region of the lever being joined with the plate first end in a generally coplanar relationship; and a spring fitted inside the spring cavity at the bottom edge of the plate, whereby the spring is tensioned to bias the plate into a linear path followed by a bolt carrier group of a firearm, whereby applying force to the lever displaces the plate out of the linear path followed by the bolt carrier group.

16. The assembly of claim 15, wherein applying force to the lever first end displaces the plate out of the linear path followed by the bolt carrier group.

17. The assembly of claim 15, wherein a catch position restricts passage of the bolt carrier group towards a rearward end of the firearm.

18. The assembly of claim 15, wherein a catch depression forms in a side of the firearm.

19. The assembly of claim 18, wherein a catch spring and a catch plunger are detachably fitted inside the catch depression.

* * * * *